US005182254A

United States Patent [19]

Owens

[11] Patent Number: 5,182,254

[45] Date of Patent: Jan. 26, 1993

[54] SUPERCONDUCTING ELECTROMAGNETIC PROJECTILE LAUNCHERS

[75] Inventor: Frank J. Owens, Denville, N.J.

[73] Assignee: The United States of America as represented by the Secretary of the Army, Washington, D.C.

[21] Appl. No.: 871,159

[22] Filed: Apr. 20, 1992

[51] Int. Cl.[5] ..... F41B 6/00

[52] U.S. Cl. ..... 505/1; 73/12; 89/8; 124/3; 505/870

[58] Field of Search ..... 73/12; 89/8; 124/3; 505/1, 870, 876, 880

[56] References Cited

U.S. PATENT DOCUMENTS

| | | | |
|---|---|---|---|
| 2,987,631 | 6/1961 | Park | 505/870 |
| 3,173,079 | 3/1965 | McFee | 505/870 |
| 3,255,335 | 6/1966 | Kortelink | 505/882 |
| 3,701,906 | 10/1972 | Denel et al. | 505/870 |
| 4,841,181 | 6/1989 | Kemeny et al. | 124/3 |
| 4,874,556 | 1/1990 | Hilal et al. | 505/870 |
| 4,986,160 | 1/1991 | Kemeny | 89/8 |

*Primary Examiner*—Stephen C. Bentley

*Attorney, Agent, or Firm*—Anthony T. Lane; Edward Goldberg; Michael C. Sachs

[57] ABSTRACT

A pair of copper rails on which a projectile is mounted forms an electromagnetic rail gun. One end of the rails is connected across an electrical coil which resides between a pair of Helmholtz coils made of a high temperature superconducting material. The Helmholtz coils are normally held in a superconducting state and carry large currents without the need of a voltage source. A thermal quencher is provided which is capable of removing the superconducting state by heating the superconducting circuit. When the temperature of the superconducting circuit rises above its critical temperature, the resistance of the wires will increase, causing the current to collapse. This sharp collapse of the current will cause a correspondingly sharp collapse of the magnetic field of the Helmholtz coils, thereby inducing a sharp current pulse in the force coil which produces a high-energy electric power pulse on the rails to launch the projectile. A magnetic quencher may be used in place of the thermal quencher. As an alternate embodiment a power cryotron is used to switch a superconducting circuit into a high-resistance state to dump the current pulse onto the rails.

3 Claims, 2 Drawing Sheets

SUPERCONDUCTING ELECTROMAGNETIC PROJECTILE LAUNCHERS

The invention described herein may be manufactured, used, and licensed by or for the Government for governmental purposes without the payment to me of any royalty thereon.

RELATED APPLICATION

This application is related to application Ser. No. 07/607,349 filed Oct. 29, 1990, by Frank J. Owens, entitled "Superconducting Electromagnetic Projectile Launchers", now abandoned.

BACKGROUND OF THE INVENTION

1. Field of the Invention

The present invention relates generally to improvements in projectile launching systems and the like and, more particularly, to new and improved electromagnetic high-velocity projectile accelerators often referred to as rail guns.

2. Description of the Prior Art

Those concerned with the propulsion of projectiles within a gun or other firing device have long recognized the unique ability of electromagnetic rail guns to propel certain projectiles to very high velocities. Electromagnetic rail guns generally comprise a pair of closely spaced, electrically conductive rails on which the projectile is designed to travel. The projectile, usually a smooth, ballisticly shaped object, is designed to slide on the surface of the rails. The projectile includes a conductive means for completing a circuit across the rails when mounted thereon. The firing mechanism for the rail gun typically includes a source of electrical energy capable of dumping a large amount of current onto the rails (rail current) in a short period of time to produce a high-energy electrical power pulse that travels along the rails. This rail current, in addition to passing through the projectile (projectile current), will induce large magnetic fields in the regions immediately adjacent the rails. As a consequence, there will be a strong interaction between the magnetic fields of the rails and the projectile current that will produce a large force that will accelerate the projectile along the rails.

One of the most critical problems confronting designers of electromagnetic rail guns has been developing improved firing mechanisms capable of accelerating projectiles to greater speeds without increasing the size and complexity of the overall system. In the past, it has been the general practice by some to employ bulky capacitor mechanisms for storing the large quantities of electrical energy. Such capacitor mechanisms usually require complicated support electronics that function to charge the capacitor mechanism, to hold and maintain the charge and to later dump the stored charge onto the rails when triggered. Others have employed equally bulky homopolar motors for producing the required launching energy. The support electronics for homopolar firing systems are also complicated and expensive.

Although such prior devices have served the purpose, their large sizes and complicated structures have often rendered them unreliable, less powerful and impractical for many applications. As such, those skilled in these arts have long recognized the need for more powerful electromagnetic rail guns that have substantially less bulk and complexity. The present invention fulfills this need.

SUMMARY OF THE INVENTION

The general purpose of this invention is to provide a superconducting projectile launcher which embraces all of the advantages of similarly employed launchers and possesses none of the aforedescribed disadvantages.

As is well known, in the superconducting state, a material has no resistance to current flow. For example, a circuit made of wire in the superconducting state can, once charged, indefinitely sustain a very large current while being totally disconnected from a voltage source. Materials which have the property to be superconductors achieve the superconducting state by being cooled below a critical temperature, Tc. Up until recently the critical temperatures Tc have been very low, below 23 degrees K. for niobium alloys. Also, such materials to become superconducting have required expensive cryrogenic coolants which often limit their applications. Nevertheless, superconducting magnetic coils capable of producing magnetic fields having flux densities in the order of 20 Tesla are being commercially made for research and other purposes.

Recently a material has been found which is a superconductor at 90 degrees K. and above. U.S. Pat. No. 4,870,052 describes materials that are superconductors above 120 degrees K.

It is an object of this invention is to provide a relatively small device for accelerating a projectile, e.g. of less than a kilogram, to very high velocities by employing the unique properties of high temperature superconducting wires. One unique property involves the ability of superconductors to rapidly leave their superconductive state. The current and magnetic fields associated with some superconducting wires have very rapid collapse times when the superconducting state is removed (quenched). For instance, the rate of increase of the resistance of a superconductor can be as much as one OHM per microsecond. Another important property of superconductors usefull in practicing the present invention is that very high magnetic energy densities can be stored in superconductors without the need for electronic power supplies to support them.

It is also well known by those skilled in these arts that quenching, i.e. the destruction of the superconductivity of a material, can be achieved by either raising the temperature of the material above the critical temperature Tc or applying a large enough magnetic field, called the critical field Hc, to the material. The transition is abrupt when one of the values Tc or Hc is reached.

In general, this invention includes a pair of copper rails on which a projectile is mounted. One end of the rails is connected across an electrical coil, called a force coil, which resides between a pair of Helmholtz coils made of high temperature superconducting material. The Helmholtz coils are normally held in a superconducting state and carry large currents without the need of a voltage source. In one aspect of the invention, a thermal quencher means is provided which is capable of removing the superconducting state by heating the superconducting circuit. When the temperature of the superconducting circuit rises above its critical temperature Tc, the resistance of the wires will increase significantly and quickly, causing the current therein to collapse. This sharp collapse of the current will cause a correspondingly sharp collapse of the magnetic field of the Helmholtz coils, thereby inducing a sharp current pulse in the force coil which produces a high-energy electrical power pulse on the rails.

This power pulse or rail current will in turn produce a magnetic field in the region of the projectile while also causing a current to flow through the projectile. Interaction between the projectile current and the magnetic field of the rails will produce the launching force on the projectile that will cause it to accelerate along the rails.

In another aspect of the invention, a magnetic quencher is used to collapse the magnetic field in the Helmholtz coils. In this embodiment, a quenching coil is coupled to a portion of the superconducting circuit. To fire the launcher, a current is applied to the quenching coil of a value sufficient to cause a critical magnetic field Hc to be applied to a portion of the superconducting circuit, thereby causing an abrupt transition of the superconducting state which will result in the dumping of a large current pulse onto the rails in the same manner as described above concerning the thermal quencher operation.

In still another aspect of the invention a cryotron circuit is employed. In this embodiment a superconducting circuit has a current flowing therein. A control coil, coupled to the superconducting circuit, switches the superconductivity of the circuit on and off. When superconductive, the circuit resistance is negligible and supports a large current. When the superconductivity is switched off by the control coil, the resistance of the circuit becomes appreciable. The value of the circuit resistance is chosen to be significantly higher than that of the rail circuit. Accordingly, when the superconductivity is switched off, the current is dumped onto the rails to effect projectile launch.

The exact nature of this invention as well as other objects and advantages thereof will be readily apparent from consideration of the following specificication relating to the annexed drawings.

DETAILED DESCRIPTION OF THE PREFERRED EMBODIMENTS

Figure 1:
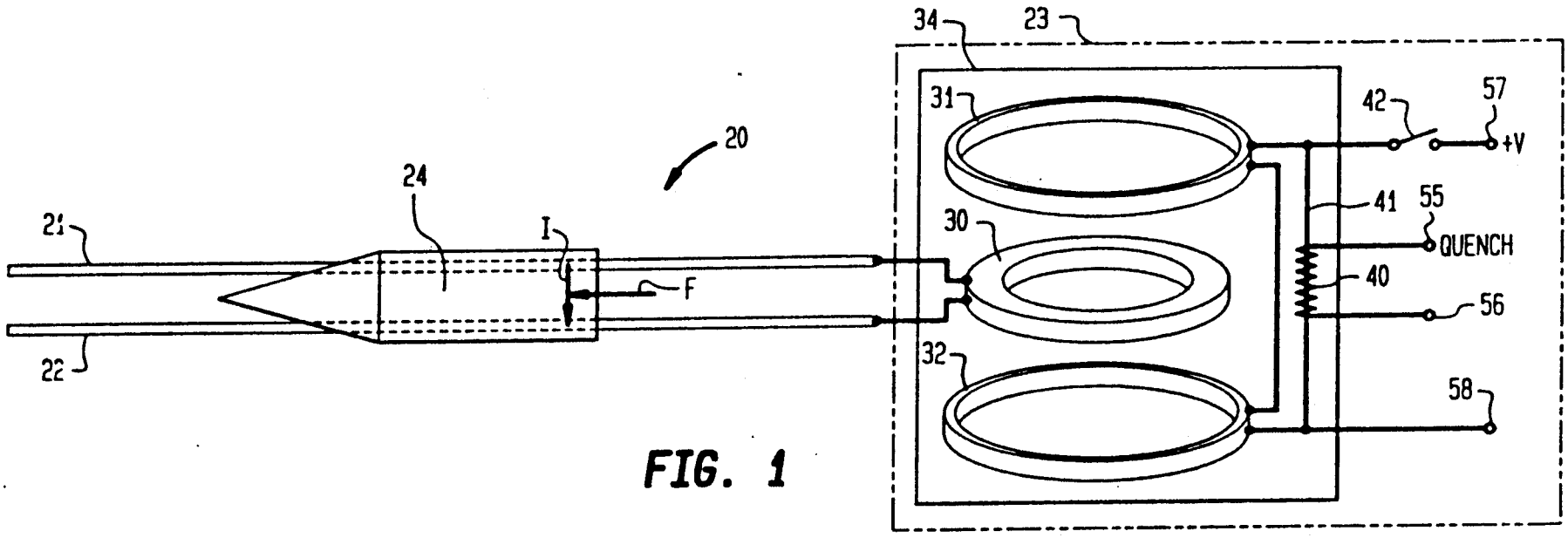
FIG. 1 is a diagrammatic pictoral view of a projectile accelerator made in accordance with the principals of the present invention.
Figure 2:
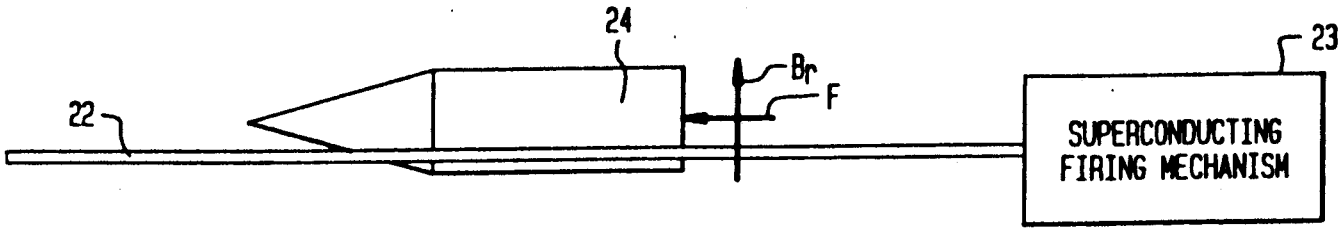
FIG. 2 is a schematic side view of the preferred embodiment.
Figure 3:
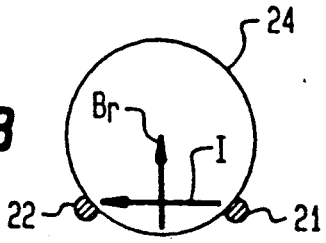
FIG. 3 shows an end view in section of the preferred embodiment.

Referring now to the drawings, there is shown in FIGS. 1-3 a superconducting, electromagnetic, high-velocity projectile accelerator referred to herein as rail gun 20. The rail gun 20 includes a pair of copper rails 21, 22 having a superconducting firing mechanism 23 connected to one end thereof. A projectile 24 rests on the rails 21, 22 such that it is free to slide thereon.

The firing mechanism 23 is designed to dump a large quantity of electrical energy onto the rails 21, 22 such that a current pulse is made to travel along the rails 21, 22 from mechanism 23 toward the other end of the rails. The current pulse will produce a magnetic field Br in the region of the projectile 24 having a resultant direction generally perpendicular to the plane of the rails 21, 22 such as indicated by the arrow (FIGS. 2, 3). The projectile 24 has a conductive path (conventional projectiles are conductive or have a special conductor provided therein) that will complete a circuit between the rails 21, 22 so as to produce a projectile current I having components directed generally in the plane of the rails as indicated by the arrow (FIG. 3). The interaction of the projectile current I and the field Br will produce a mutually perpendicular force F on the projectile 24 that will accelerate it toward the end of the rails 21, 22.

FIG. 1, which schematically illustrates the details of the superconducting firing mechanism 23, shows a force coil 30 connected across the end of rails 21, 22. Force coil 30 is sandwiched between a pair of superconducting Helmholtz coils 31, 32. Coils 30, 31 and 32 are all arranged with a common axis. Helmholtz coils 31 and 32 are preferably arranged as a pair of flat, circular coils having equal numbers of turns and equal diameters. Coils 31, 32 are connected in series by a conductor 41 to obtain an additive magnetic field that passes through the force coil 30 and wherein the field is more nearly uniform than that produced by a single coil. Helmholtz coils 31, 32 are encased in a thermally insulating container 34 made of a material that is both electrically nonconductive and nonmagnetic such as styrofoam or the like. Coils 31 and 32 may be made of wires of the high-temperature copper oxide superconductors. Force coil 30 may also be a flat circular coil. Its ends are connected across the ends of rails 21, 22. Force coil 30, although not superconductive, may also be located in the container 34 as illustrated.

In a typical device, the projectile 24 is about one kilogram or less, the rails 21, 22 are separated by about 5 cm and the force coil 30 has 100 windings or more with a radius in the range of 0.07 cm. At present, when using wires made of the new superconducting materials, such as those described in U.S. Pat. No. 4,870,052 or the like, a coolant, such as liquid nitrogen, must be placed in the insulating container 34. However, when room temperature superconductors are developed, a simple thermal insulator alone mounted about the wires should be sufficient. It is also noted that the coils 30, 31, 32 will have to be contained in, for example, a strong epoxy or ceramic material in order to constrain then because of the large forces that will be produced between the wires.

A quenching apparatus forms a part of the superconducting firing mechanism 23 for triggering the gun 20. A thermal quencher, illustrated in FIG. 1, has a heating resistor 40 that is wrapped around or otherwise closely coupled to wire 41 or another part of the superconducting circuit. When triggering is to occur, a quench voltage is applied across resistor 40 via terminals 55, 56 to heat the wire 41. When the temperature of wire 41 reaches the critical temperature Tc, the wire 41 loses its superconductive state, thereby causing the complete circuit including coils 31, 32 to cease being superconductive.

Also illustrated in FIG. 1 is a pair of charging terminals 57, 58 with a switch 42 for applying a charging voltage +V to the coils 31, 32. Once a sufficient current is flowing in the normally superconducting coils 31, 32, the switch 42 may be opened. The current will continue to flow in the coils 31, 32 and, of course, the connecting wires including wire 41 as long as the circuit remains in the superconductive state.

This device is different from present electromagnetic launch systems in that the current pulse in the rail circuit is produced by the collapse of the superconducting state in coils 31, 32. Because the superconducting state can collapse very rapidly and because the initial coil current can be very large, a large $\Delta B/\Delta t$, where t is time and B is magnetic flux density, is produced, which means a large current I will flow in the rail circuit. Further, unlike conventional rail guns, no support electronics is necessary to dump the current I. The magnetic field in coils 31, 32 can be sustained without any power supply. A small heating resistor 40, used as a quencher, is all that is necessary to remove the superconducting state from the coils 31, 32. Further, because of the high current I possible in the rail circuit, and the absence of complicated electronics, the overall device may be quite small. It will now be shown that in a practical device, high velocities v can be obtained with rails 21, 22 of no more than 2 meters long.

Symbols used in the following equations are defined as follows:

| Symbol | Parameters |
|---|---|
| A | Area of coil 30 |
| r | Radius of coil 30 |
| N | Number of turns in coil 30 |
| R | Resistance of coil 30 |
| L | Inductance of coil 30 |
| E | Output voltage of coil 30 |
| $\phi$ | Magnetic flux through coil 30 |
| B | Magnetic induction of coil 30 |
| l | Length of conductive path in projectile 24 |
| s | Separation of the rails 21, 22 |
| M | Mass of projectile 24 |
| X | Distance traveled by projectile 24 |
| b | Length of rails 21, 22 |
| v | Velocity of projectile 24 |
| a | Acceleration of projectile 24 |
| F | Force on projectile 24 |
| I | Rail current and projectile current |
| Br | Magnetic induction of field produced by current I on rails 21, 22 |
| Uo | Magnetic permeability of free space |

The Voltage, E, produced in the force coil 30 is:

$$E = \frac{-d\phi}{dt} \tag{1}$$

Where $\phi$, the magnetic flux through the force coil 30, is given by B·A. Accordingly, the voltage E may be expressed as follows:

$$E = \frac{-dB}{dt}\pi r^2 N \tag{2}$$

Since the force coil 30 and rails 21, 22 combine to be essentially a resistive-inductive circuit, the current in the rails 21, 22 will be $$I = I_o(1-e^{-t/\tau}) \tag{3}$$

Where $\tau$ is L/R, i.e. the time constant of the rail circuit. The comparative resistance and inductance of the rails 21, 22 are considered. Io may be expressed as follows:

$$I_o = \frac{dB}{dt}\ \frac{\pi r^2 N}{R} \tag{4}$$

the force on the projectile 24 is $$F = BIl \tag{5}$$

The magnetic field B at the base of the projectile produced by the current I in the rails 21, 22 can be shown to be $$B = \frac{U_o T}{\pi l}\ \frac{b}{(b^2 + l^2/4)^{\frac{1}{2}}} \tag{6}$$

Combining Eq. (6) with Eq. (5), the fore F on the projectile 24 is $$F = \frac{U_o I^2}{\pi}\ \frac{b}{(b^2 + l^2/4)^{\frac{1}{2}}} \tag{7}$$

The acceleration a(t) of projectile 24 is $$a(t) = K(1-e^{-t/\tau})^2 \tag{8}$$

Where K is defined as $$K = \frac{U_o}{4\pi M}\ \frac{b}{(b^2 - l^2/4)^{\frac{1}{2}}}\left(\frac{\Delta B}{\Delta t}\pi r^2 N\right)^2 \tag{9}$$

The velocity v of projectile 24 at a given time t is $$v = \int_o^t a(t)dt$$

which becomes $$v = Kt - 3/2K\tau + K\tau[2e^{-t/\tau} - \tfrac{1}{2}e^{-t/\tau}] \tag{10}$$

The distance X traveled by projectile 24 is $$X = \tfrac{1}{2}Kt^2 - 3/2K\tau t + 7/4K\tau^2 + K\tau^2(\tfrac{1}{2}e^{-2t/\tau} - 2e^{-t/\tau}) \tag{11}$$

which is obtained from $$X = \int_o^t v dt \tag{12}$$

In order to evaluate the possible projectile velocities v that can be achieved, the following values for the parameters are chosen: $t=10^{-3}$ s; $\Delta B/\Delta t=10^{-4}$ T/S; r=0.07 meters; b=2 meters; l=0.05 meters; N=100; R=10 ohms; L=10 H and M=200 grams.

The slope of B with respect to t is assumed to be constant. Using these values and the above equations, a rail of 2 meters long can eject a 200 G projectile with a velocity of 18 Km/S. Note that in practice a much higher value of B is possible. It should be emphasized that this velocity v is an upper limit for the assumed parameters. The real velocity v will be somewhat lower because of such things as friction between the projectile 24 and the rails 21, 22. The above analysis has also neglected the fact that the value of b is changing in time.

Figure 4:
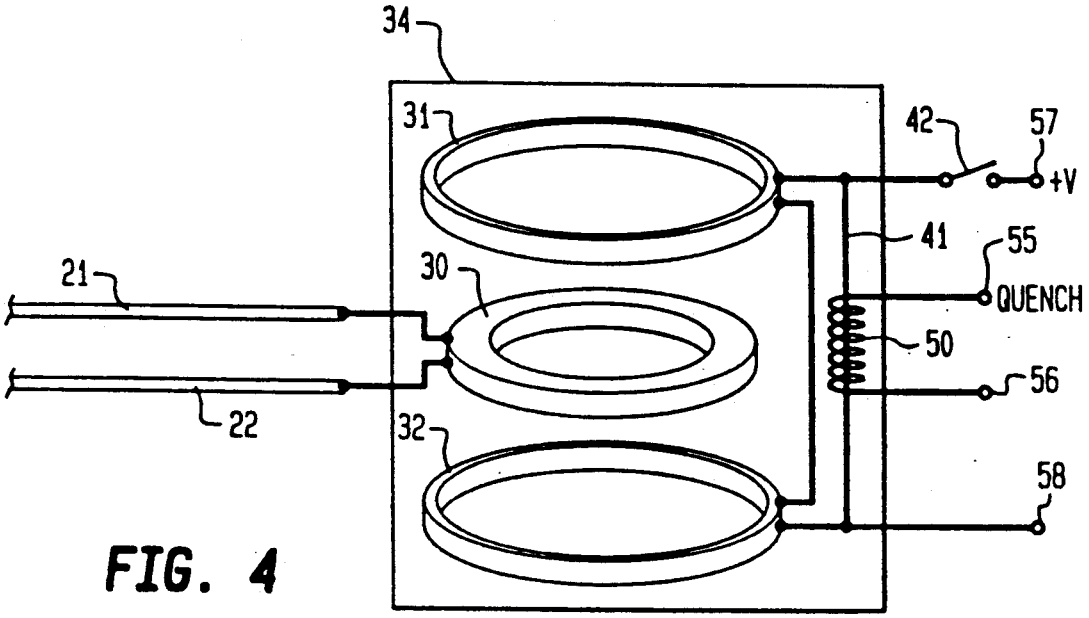
FIG. 4 shows a detail of an alternate embodiment of the invention.

FIG. 4 illustrates an alternative quenching structure. The quenching rates of a thermal quenching structure built in accordance with FIG. 1 may be somewhat slower than a magnetic quencher such as shown in FIG. 4. In FIG. 4 a coil 50 is coupled to the superconducting wire 41. When a voltage is applied to the quench terminals 55, 56, coil 50 applies a magnetic field to wire 41. When this applied magnetic field reaches the critical field Hc, the superconducting state will be destroyed thereby quenching the coils 31, 32. As in the FIG. 1 embodiment, the magnetic field of the quenched coils 31, 32 will collapse and produce a current pulse on rails 21, 22 via force coil 30.

Figure 5:
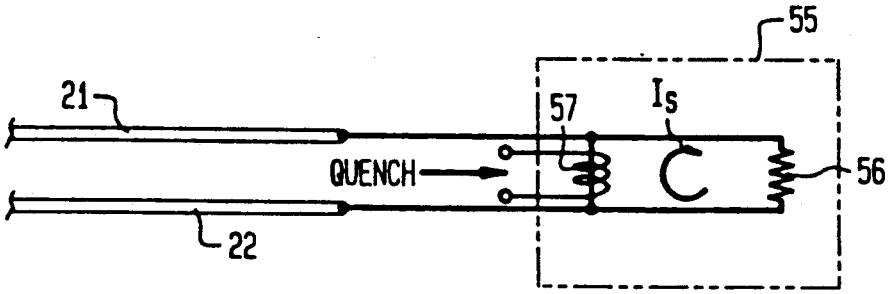
FIG. 5 shows a still further alternate embodiment of the invention.

An alternative design to the arrangement in FIGS. 1 and 4, which would eliminate the coils 30, 31, 32, would be to have the rails 21, 22 be a load on a power cryotron 55 as shown in FIG. 5. The cryotron 55 includes a superconducting loop, which has an effective negligible resistance, shown here as lumped resistance 56, when in the superconducting state. The cryotron 55 supports a superconducting current Is in the loop. One branch of the loop has a control coil 57 coupled thereto. When sufficient voltage is applied to coil 57 to produce a magnetic field in the superconducting wire of a value that exceeds the critical field Hc of the superconducting wire, superconductivity will cease and the value of the effective resistance 56 will abruptly become large and appreciable. It is contemplated that the resistance 56, when in the non-superconducting state, have a value that is significantly greater than the resistance of the rail circuit. As such, the electrical energy contained in the loop current Is of the cryotron 55 will be dumped onto the rails 21, 22 thereby causing a current pulse that will launch a projectile mounted thereon. In a typical application, the resistance 56 can increase in the order of $10^6$ ohms per second. It is noted that the large currents produced in the rails 21, 22 would in turn produce a large force between the rails 21, 22 which would tend to cause them to fly apart. As such, the rails 21, 22 should be constrained with strong materials. Using equation (4) and the assumed parameters, the maximum current in the rails 21, 22 would be $7.85\times10^6$ amperes, the force between the rails 21, 22 is $$F=U_0bI_0^2/2\pi s$$

where b is the length of the rails and s the separation of the rails. For rails 21, 22, two meters long and spaced five centimeters apart, the force pushing the rails 21, 22 apart would be $1.232\times10^8$ Newtons. This is a relatively large force. As is evident to those skilled in these arts, special supporting structures for rails 21, 22 will be required.

There are a number of possible applications for rail guns that are well known to those skilled in these arts. However, the present rail gun 20 may find special application as a means for generating shock pulses for research purposes. A shock wave is a compression pulse moving through a solid at a velocity faster than the velocity of sound for the total material. The effects of shock waves on solids is a subject of much research interest. Shock waves in solids are often generated by impacting a high-velocity flyer plate on the solid. Thus, the gun 20 could easily be employed as a shock gun by using a thin plate as the projectile 24.

Obviously many other modifications, variations and applications of the present invention are possible in the light of the above teachings. The foregoing disclosure and drawings are merely illustrative of the principles of this invention and are not to be interpreted in a limiting sense. It is to be understood that the invention should not be limited to the exact details of construction shown and described because obvious modifications will occur to a person skilled in the art.

What is claimed is:

1. An electromagnetic projectile launcher comprising:

a pair of conductive rails mounted parallel to each other in a common plane and including means for permitting a projectile to accelerate thereon:

a force coil comprising a flat circular coil including outputs connected in parallel to said rails for dumping a first electrical energy onto said rails whereby to launch said projectile along said rails;

superconducting circuit means for storing a second electrical energy, said superconducting circuit means comprising a pair of Helmholtz superconducting coils which sandwich said force coil inbetween, centered coaxially, but are not electrically conductive to said force coil; said Helmholtz coils being electrically coupled to one another and carrying common series current when in the superconductive state; said superconducting circuit means including a quenching means for selectively causing said superconducting coils to cease being superconductive, to cause said stored second electrical energy to collapse and induce said first electrical energy within said force coil, whereby said first electrical energy is dumped onto said rails, causing said projectile to be launched, said superconducting circuit means having a resistance in its non-superconducting state that is significantly higher than the resistance of said rails.

2. The launcher of claim 1 wherein said quenching means includes a magnetic means for applying a magnetic filed to a portion of said superconducting means to cause said coils to cease being superconductive.

3. The launcher of claim 1 wherein said quenching means include means for heating at least a portion of said superconducting means to cause said coils to cease being superconductive.

* * * * *